US010428291B2

(12) United States Patent
Trobaugh et al.

(10) Patent No.: US 10,428,291 B2
(45) Date of Patent: Oct. 1, 2019

(54) ASHLESS OIL ADDITIVES AND THEIR USE AS TBN BOOSTERS

(71) Applicant: Cummins Filtration IP, Inc., Columbus, IN (US)

(72) Inventors: Corey W. Trobaugh, Columbus, IN (US); Jonathan D. Sheumaker, Cookeville, TN (US); Eduardo Javier Pereira, Cookeville, TN (US); Natashia J. Bass, Cookeville, TN (US)

(73) Assignee: Cummins Filtration IP, Inc., Columbus, IN (US)

( * ) Notice: Subject to any disclaimer, the term of this patent is extended or adjusted under 35 U.S.C. 154(b) by 281 days.

(21) Appl. No.: 15/129,357

(22) PCT Filed: Mar. 20, 2015

(86) PCT No.: PCT/US2015/021733
§ 371 (c)(1),
(2) Date: Sep. 26, 2016

(87) PCT Pub. No.: WO2015/148301
PCT Pub. Date: Oct. 1, 2015

(65) Prior Publication Data

US 2017/0175024 A1 Jun. 22, 2017

Related U.S. Application Data

(60) Provisional application No. 61/971,976, filed on Mar. 28, 2014.

(51) Int. Cl.
*C10M 133/40* (2006.01)

(52) U.S. Cl.
CPC .... *C10M 133/40* (2013.01); *C10M 2215/221* (2013.01); *C10N 2230/45* (2013.01);
(Continued)

(58) Field of Classification Search
CPC ..... C10M 133/40; C10M 2215/221; C10N 2230/52; C10N 2230/72; C10N 2240/10; C10N 2240/102; C10N 2230/45
(Continued)

(56) References Cited

U.S. PATENT DOCUMENTS 7,718,586 B2 * 5/2010 Schield ..... C10G 29/20 508/243
7,749,948 B2 7/2010 Bardasz et al.
(Continued)

FOREIGN PATENT DOCUMENTS

CN 201696142 U 1/2011
CN 102341573 A 2/2012
(Continued)

OTHER PUBLICATIONS

Sigma-Aldrich Catalog, Date Unknown (Year: 0000).*
(Continued)

*Primary Examiner* — Cephia D Toomer
(74) *Attorney, Agent, or Firm* — Foley & Lardner LLP

(57) ABSTRACT

Described herein is an ashless oil additive, comprising at least one diazabicyclo or triazabicyclo compound. Also described is a composition comprising an engine oil mixed with an oil additive, wherein the oil additive comprises at least one diazabicyclo or triazabicyclo compound. Further described is a method for boosting the total base number (TBN) of an engine oil composition, comprising adding an oil additive to said engine oil composition, wherein the oil additive comprises at least one diazabicyclo or triazabicyclo compound.

22 Claims, 1 Drawing Sheet

(52) U.S. Cl.
CPC ..... *C10N 2230/52* (2013.01); *C10N 2230/72* (2013.01); *C10N 2240/10* (2013.01); *C10N 2240/102* (2013.01)

(58) Field of Classification Search
USPC ..... 508/243
See application file for complete search history.

(56) References Cited

U.S. PATENT DOCUMENTS

| | | | |
|---|---|---|---|
| 8,242,066 | B2 | 8/2012 | Cheng et al. |
| 8,288,328 | B1 | 10/2012 | Cheng et al. |
| 8,513,169 | B2 | 8/2013 | Diggs et al. |
| 2009/0087788 | A1 | 4/2009 | Kanchiku |
| 2010/0147238 | A1 | 6/2010 | Kurihara et al. |
| 2012/0291737 | A1 | 11/2012 | Mathur et al. |
| 2013/0101840 | A1 | 4/2013 | Yang et al. |
| 2013/0102728 | A1 | 4/2013 | Yang et al. |
| 2013/0230929 | A1 | 9/2013 | Nakamura et al. |
| 2013/0252865 | A1 | 9/2013 | Hartley et al. |

FOREIGN PATENT DOCUMENTS

| | | | |
|---|---|---|---|
| CN | 102586005 | A | 7/2012 |
| EP | 2 319 904 | | 5/2011 |
| JP | 2011-149019 | A | 8/2011 |
| WO | WO-03/000652 | | 1/2003 |
| WO | WO-2011/059583 | | 5/2011 |
| WO | WO-2012/166781 | | 12/2012 |
| WO | WO-2013/066585 | | 5/2013 |

OTHER PUBLICATIONS

Search Report and Written Opinion for PCT/US2015/021733, dated Jun. 19, 2015, 9 pages.

First Office Action cited for Chinese Patent Application No. 201580014608.2, with English Translation, dated Jun. 19, 2018,, 11 pages.

Second Office Action cited for Chinese Patent Application No. 201580014608.2, with English Translation, dated Feb. 28, 2019, 11 pages.

* cited by examiner

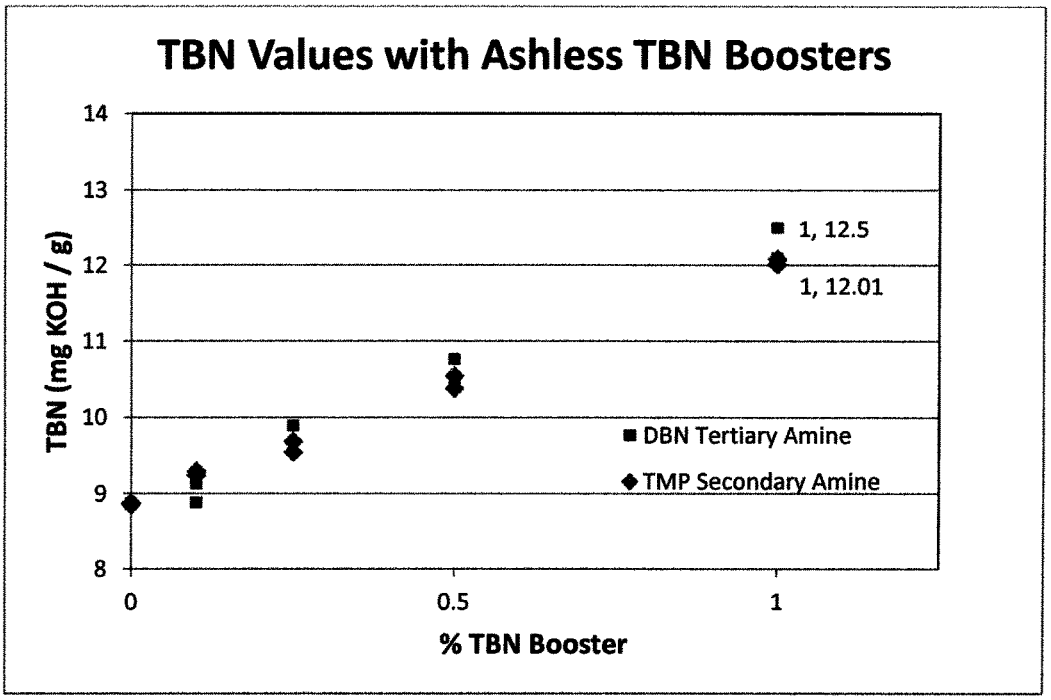
TBN Values with Ashless TBN Boosters
TBN (mg KOH / g)
14
13
12
11
10
9
8
0
0.5
1
% TBN Booster
1, 12.5
1, 12.01
DBN Tertiary Amine
TMP Secondary Amine

ASHLESS OIL ADDITIVES AND THEIR USE AS TBN BOOSTERS

CROSS-REFERENCE TO RELATED APPLICATIONS

The present application is a U.S. national stage application claiming the benefit of International Application No. PCT/US2015/021733, filed on Mar. 20, 2015, which claims the benefit of and priority to U.S. Patent Provisional Application No. 61/971,976, filed Mar. 28, 2014. The contents of both applications are incorporated herein by reference in their entirety.

BACKGROUND

Current engine oils are not equipped to handle long oil drain intervals in many commercial engines. Metal based TBN (total base number) boosters have been designed to neutralize the acids generated by the combustion process and to ultimately protect the soft metals from increased corrosion. Metal based TBN boosters have limitations—with normal oil consumption levels, the ash-based chemicals participate in the combustion process and eventually decrease the usable life of the after-treatment systems. Servicing and replacing after-treatment systems, however, is time intensive and expensive. Because of their negative impact on the after-treatment filters, it is difficult to include a sufficient concentration of these metallic based chemicals for longer corrosion protection and longer oil drain intervals.

SUMMARY

By utilizing novel ashless TBN boosters described herein, the acid neutralizing capability of the engine oil can be increased substantially without increasing damage to the after-treatment filters. The TBN boosters described herein are applicable to both diesel and natural gas engines. Indeed, natural gas engines are more susceptible to ash producing additives, with the limit of ash present in natural gas engine oil being 0.6% (vs. 1% for diesel engines), and have struggled to get reasonable oil drain intervals. The TBN boosters described herein would greatly improve the oil drain intervals for both diesel and natural gas engines.

Many embodiments described herein relate to an ashless oil additive, comprising at least one diazabicyclo or triazabicyclo compound, wherein the diazabicyclo or triazabicyclo compound comprises at least two tertiary amines.

In some embodiments, the diazabicyclo or triazabicyclo compound is represented by formula (I), (II) or (III):

(I)

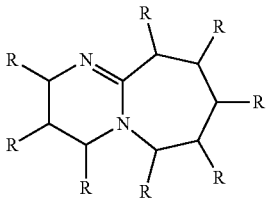

(II)

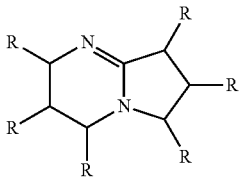

-continued (III)

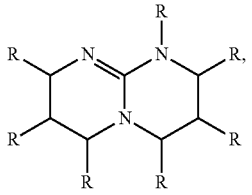

and wherein each R is independently hydrogen, a C1-C12 alkyl group, or a C1-C12 alkyl group containing one or more heteroatoms such as Oxygen, Sulfur or Nitrogen.

In some embodiments, the diazabicyclo or triazabicyclo compound is selected from the group consisting of 1,5-Diazabicyclo[4.3.0]non-5-ene (DBN), 1,8-Diazabicyclo[5.4.0]undec-7-ene (DBU), 1,5,7-Triazabicyclo[4,4,0]dec-5-ene (TBD), and 7-Methyl-1,5,7-Triazabicyclo[4,4,0]dec-5-ene (MTBD).

Other embodiments relate to a composition comprising an engine oil mixed with the oil additive described herein.

Additional embodiments relate to a method for boosting the total base number (TBN) of an engine oil composition, comprising adding the oil additive described herein to the engine oil composition.

These and other features, together with the organization and manner of operation thereof, will become apparent from the following detailed description when taken in conjunction with the accompanying drawings

BRIEF SUMMARY OF THE FIGURES

FIG. 1 shows the TBN values of fresh engine oils supplemented with various amounts of 1,5-diazabicyclo[4.3.0]non-5-ene (DBN) and 2,2,6,6-tetramethyl piperidine (TMP).

DETAILED DESCRIPTION

This disclosure relates to the use of amine-based organic bases as oil additives that function as TBN boosters. With the growing number of after-treatment failures due to increased back pressure because of ash loading on the filter, there is an industry wide initiative to evaluate alternative oil additives that are nonmetallic based. Surprisingly, it is discovered that certain tertiary amine chemicals are suitable as oil soluble TBN boosters. These chemicals work by absorbing acidic protons that have formed in the oil. These acid groups would otherwise attack and remove soft metals such as lead from bearings and bushings. The lead could be present to provide a cushion for the bearing and to delay wear. When the metal is removed by acids, it can cause increased wear on the bearing itself and matching crankshaft.

The tertiary amine chemicals described herein include bicyclic compounds that contain at least two, or at least three, tertiary amines. The bicyclic nature of the molecule affords high basicity and low nucleophilicity. Incorporating poor nucleophiles as oil additives can decrease the chances of side reactions and antagonistic interactions with other lubricant additives and engine components. The core structures of the bicyclic compounds can be functionalized to further minimize the potential of side reactions in lubricating oil.

The functionalization can also be designed to enhance cold temperature operability. For example, by functionalizing the cyclic amines with long hydrocarbon chains, miscibility can be adjusted, and cold weather properties can be improved. With certain functionalization, the TBN boosting power of the nitrogen groups can also be enhanced.

Additionally, incorporating heteroatoms such as oxygen, sulfur and nitrogen into the alkyl groups allows manipulation of the electronic properties of the parent molecule. Incorporating an oxygen group in various forms can increase or decrease the electron withdrawing and/or electron donating function of the parent molecule depending on its location. Adjusting these parameters can significantly impact the parent molecules basicity or nucleophilicity to favor better efficacy.

Exemplary chemical structures of some of the bicyclic tertiary amine chemicals described herein are provided below.

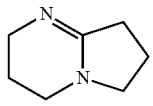

1,5-Diazbicyclo(4.3.0)non-5-ene

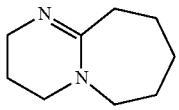

1,8-Diazbicyclo[5.4.0]undec-7-ene

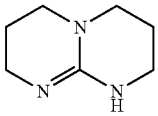

1,5,7-Triazabicyclo[4.4.0]dec-5-ene

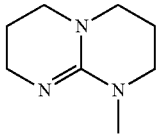

7-Methyl-1,5,7-triazabicyclo[4.4.0]dec-5-ene

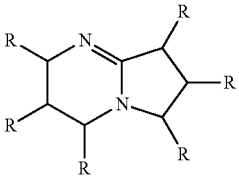

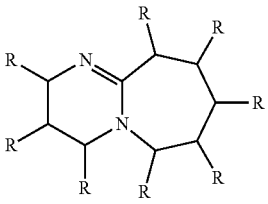

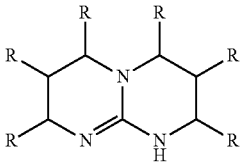

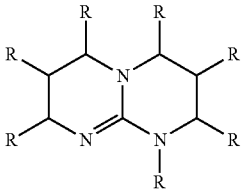

R=C1-C20. Every position does not need to be functionalized. Drawing is meant to show that each location could be. See below for an example.

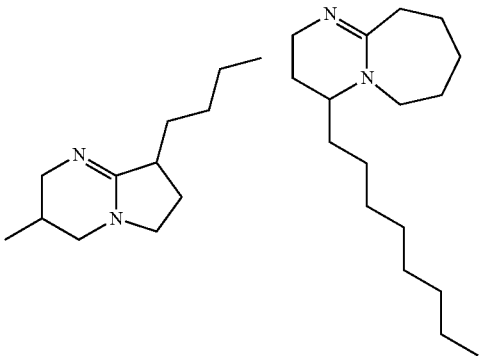

The ashless oil additive described herein can comprise, for example, at least one diazabicyclo or triazabicyclo compound. The diazabicyclo or triazabicyclo compound can comprise, for example, at least two or at least three tertiary amines. The diazabicyclo or triazabicyclo compound can be, for example, optionally substituted with at least one linear or branched C1-C20, C1-C12, or C1-C6 organic group containing zero or at least one heteroatom, such as oxygen, sulfur or nitrogen.

The diazabicyclo or triazabicyclo compound can be represented by, for example, formula (I), (II) or (III):

(I)

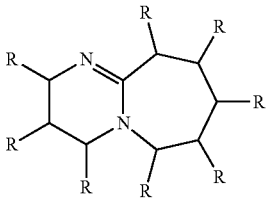

(II)

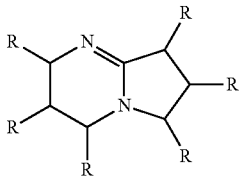

(III)

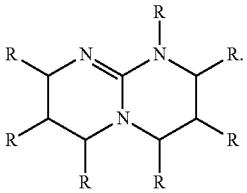

Each R can be independently selected from, for example, hydrogen, or a linear or branched C1-C20, C1-C12, or C1-C6 alkyl group, containing zero or at least one heteroatom, such as oxygen, sulfur or nitrogen.

In some embodiments, the ashless oil additive comprises a diazabicyclo compound represented by formula I. In one embodiment, each R is hydrogen, and the diazabicyclo compound is 1,8-Diazabicyclo[5.4.0]undec-7-ene. In another embodiment, at least one R is a C1-C20, C1-C12, or C1-C6 alkyl group. In another embodiment, the R group can contain zero or at least one heteroatom, such as oxygen, sulfur or nitrogen, in the alkyl group.

In some embodiments, the ashless oil additive comprises a diazabicyclo compound represented by formula II. In one embodiment, each R is hydrogen, and the diazabicyclo compound is 1,5-Diazabicyclo[4.3.0]non-5-ene. In another embodiment, at least one R is a C1-C20, C1-C12, or C1-C6 alkyl group. In another embodiment, the R group can contain zero or at least one heteroatom, such as oxygen, sulfur or nitrogen, in the alkyl group.

In some embodiments, the ashless oil additive comprises a triazabicyclo compound represented by formula III. In one embodiment, the N—R group comprises a C1-C20, C1-C12, or C1-C6 alkyl substituent group, optionally comprising at least one heteroatom such as oxygen, sulfur, or nitrogen. In another embodiment, the N—R group comprises a methyl substituent group, while each other R is hydrogen, and the triazabicyclo compound is 7-methyl-1,5,7-triazabicyclo[4,4, 0]dec-5-ene. In another embodiment, the N—R group comprises a methyl substituent group, and at least one other R is a C1-C20, C1-C12, or C1-C6 alkyl group. In another embodiment, the R group can contain zero or at least one heteroatom, such as oxygen, sulfur or nitrogen, in the alkyl group.

In some embodiments, the ashless oil additive comprises a triazabicyclo compound represented by formula (IV):

(IV)

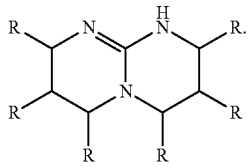

In one embodiment, each R is hydrogen, and the triazabicyclo compound is 1,5,7-triazabicyclo[4,4,0]dec-5-ene. In another embodiment, at least one R is a C1-C20, C1-C12, or C1-C6 alkyl group. In another embodiment, the R group can contain zero or at least one heteroatom, such as oxygen, sulfur or nitrogen, in the alkyl group.

In some embodiments, the diazabicyclo or triazabicyclo compound comprises a first, six membered ring comprising at least two nitrogen atoms fused to a second, five-to-seven membered ring. In some embodiments, the first ring is represented by formula (V):

(V)

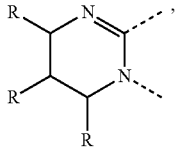

wherein each R is independently hydrogen, a C1-C20, C1-C12 or C1-C6 alkyl group. In another embodiment, the R group can contain zero or at least one heteroatom, such as oxygen, sulfur or nitrogen, in the alkyl group.

In one embodiment, the second ring is a five membered ring. It is also possible for the second ring to be a six membered ring or a seven membered ring. In one embodiment, the second ring comprises no additional heteroatom in the ring. In one embodiment, the second ring comprises at least one additional heteroatom in the ring. In one embodiment, the second ring comprises at least one additional tertiary amine group, optionally in the meta position. In one embodiment, the second ring comprises one or more substituents selected from C1-C20, C1-C12, or C1-C6 organic groups. In another embodiment, the organic group can contain zero or at least one heteroatom, such as oxygen, sulfur or nitrogen, in the alkyl group.

The diazabicyclo or triazabicyclo compound can have, for example, inherent or neat base numbers of 300-650 mg KOH/g, or 350-600 mg KOH/g, or 400-550 mg KOH/g, or 450-500 mg KOH/g. The higher the latent base number, the more proton accepting the molecule can be.

Embodiments described herein also relate to a composition comprising an engine oil mixed with any of the ashless oil additive described above. The amount of the diazabicyclo or triazabicyclo compound mixed in the engine oil composition can be, for example, up to 10% (w/w), up to 5% (w/w), up to 3% (w/w), up to 2% (w/w), or up to 1% (w/w). In one embodiment, the composition is used in a diesel engine. In another embodiment, the composition is used in a natural gas engine.

The ashless oil additive can be, for example, substantially free of metal species. The ashless oil additive can be, for example, substantially free of any amine-based cyclic compound that comprises only secondary amine.

Embodiments described herein also relates to a method for boosting the TBN of an engine oil composition, comprising adding any of the ashless oil additive described above to the engine oil composition. In one embodiment, the inclusion of the diazabicyclo or triazabicyclo compound can increase the initial TBN of a fresh oil composition by, for example, at least 1 mg KOH/g, or at least 2 mg KOH/g, or at least 3 mg KOH/g, or at least 4 mg KOH/g. In another embodiment, the inclusion of the diazabicyclo or triazabicyclo compound can increase the initial TBN of a used oil composition by, for example, at least 1 mg KOH/g, at least 2 mg KOH/g, at least 3 mg KOH/g, or at least 4 mg KOH/g.

In one embodiment, the use of the ashless oil additive described above increases standard oil drain intervals for a diesel or natural gas engine by, for example, at least 10%, or at least 20%, or at least 50%, or at least 100%, compared to an oil additive based on one or more metallic TBN boosters. In another embodiment, the use of the ashless oil additive described above increases standard oil drain intervals for a diesel or natural gas engine by, for example, at least 10%, or at least 20%, or at least 50%, or at least 100%, compared to an oil additive based on 2,2,6,6-tetramethyl piperidine as TBN booster.

WORKING EXAMPLES

Example 1

The TBN of fresh engine oils supplemented with various amounts of either 1,5-diazabicyclo[4.3.0]non-5-ene or a secondary-amine-based additive were tested.

As shown in FIG. 1, the addition of 1% (w/w) of 1,5-diazabicyclo[4.3.0]non-5-ene increased the initial TBN of fresh oil by ~3 points. In comparison, the addition of 1% (w/w) of 2,2,6,6-tetramethyl piperidine increased the initial TBN of fresh oil by ~2.5 points.

Example 2

The TBN of [1,8]diazabicyclo and [1,5]diazabicyclo were tested either neat or in 9 g of mineral oil. The results are shown in the table below.

| Sample | Sample Size | TBN (mg KOH/g) |
|---|---|---|
| [1,8] Diazabicyclo (neat) in 100 mL of TBN solvent run 1 | 0.012 g | 636.27 |
| [1,8] Diazabicyclo (neat) in 100 mL of TBN solvent run 2 | 0.016 g | 346.77 |
| [1,8] Diazabicyclo (neat) in 100 mL of TBN solvent run 3 | 0.014 g | 421.15 |
| 1 g of [1,8] Diazabicyclo (in 9 g of mineral oil) in 100 mL of TBN solvent run 1 | 0.112 g | 42.02 |
| 1 g of [1,8] Diazabicyclo (in 9 g of mineral oil) in 100 mL of TBN solvent run 2 | 0.106 g | 40.54 |
| [1,5] Diazabicyclo (neat) in 100 mL of TBN solvent run 1 | 0.018 g | 577.21 |
| [1,5] Diazabicyclo (neat) in 100 mL of TBN solvent run 2 | 0.011 g | 318.75 |

-continued

| Sample | Sample Size | TBN (mg KOH/g) |
|---|---|---|
| [1,5] Diazabicyclo (neat) in 100 mL of TBN solvent run 3 | 0.013 g | 543.31 |
| 1 g of [1,5] Diazabicyclo (in 9 g of mineral oil) in 100 mL of TBN solvent run 1 | 0.142 g | 42.67 |
| 1 g of [1,5] Diazabicyclo (in 9 g of mineral oil) in 100 mL of TBN solvent run 2 | 0.160 g | 42.32 |

In the foregoing description, it will be readily apparent to one skilled in the art that varying substitutions and modifications may be made to the invention disclosed herein without departing from the scope and spirit of the invention. The invention illustratively described herein suitably may be practiced in the absence of any element or elements, limitation or limitations which is not specifically disclosed herein. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention. Thus, it should be understood that although the present invention has been illustrated by specific embodiments and optional features, modification and/or variation of the concepts herein disclosed may be resorted to by those skilled in the art, and that such modifications and variations are considered to be within the scope of this invention.

What is claimed is:

1. An engine oil composition, comprising:

an engine oil; and an ashless oil additive comprising at least one diazabicyclo or triazabicyclo compound, wherein the diazabicyclo or triazabicyclo compound comprises at least three tertiary amines.

2. The engine oil composition of claim 1, wherein the at least one diazabicyclo or triazabicyclo compound is a triazabicyclo compound represented by the formula (III):

(III)

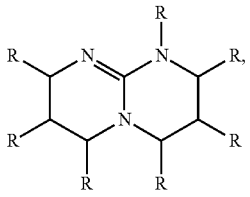

and wherein each R is independently hydrogen or a C1-C12 alkyl group optionally containing at least one heteroatom selected from Oxygen, Sulfur and Nitrogen.

3. The engine oil composition of claim 1, wherein the at least one diazabicyclo or triazabicyclo compound is a triazabicyclo compound represented by formula (IV):

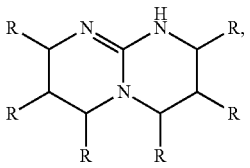

wherein each R is independently hydrogen or a C1-C12 alkyl group optionally containing at least one heteroatom selected from Oxygen, Sulfur and Nitrogen.

4. The engine oil composition of claim 1, wherein the diazabicyclo or triazabicyclo compound is selected from the group consisting of 1,5,7-Triazabicyclo[4.4.0]dec-5-ene, and 7-Methyl-1,5,7-triazabicyclo[4.4.0]dec-5-ene.

5. The engine oil composition of claim 1, wherein the diazabicyclo or triazabicyclo compound comprises a first, six membered ring comprising at least two nitrogen atoms fused to a second, five-to-seven membered ring.

6. The engine oil composition of claim 5, wherein the first ring is represented by

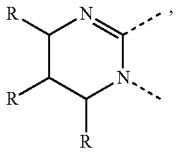

and wherein each R is independently hydrogen or a C1-C12 alkyl group optionally containing at least one heteroatom selected from Oxygen, Sulfur and Nitrogen.

7. The engine oil composition of claim 1, wherein the ashless oil additive has a base number of 300-650 mg KOH/g.

8. The engine oil composition of claim 1, wherein the ashless oil additive is substantially free of any metal species.

9. The engine oil composition of claim 1, wherein the ashless oil additive is substantially free of any amine-based cyclic compound comprising only secondary amines.

10. A method for boosting the total base number (TBN) of an engine oil, comprising adding an ashless oil additive to said engine oil, the ashless oil additive comprising at least one diazabicyclo or triazabicyclo compound, wherein the diazabicyclo or triazabicyclo compound comprises at least three tertiary amines.

11. The method of claim 10, wherein the engine oil comprises a fresh engine oil.

12. The method of claim 10, wherein the engine oil comprises a used engine oil.

13. The method of claim 10, wherein the ashless oil additive increases the total base number of the engine oil by at least 1 mg KOH/g.

14. The method of claim 10, wherein the ashless oil additive increases oil drain intervals of the engine oil by at least 10%.

15. An engine system, comprising an engine configured to operate using diesel or natural gas as a fuel, the engine including the engine oil composition of claim 1.

16. The engine oil composition of claim 2, wherein each R is independently hydrogen or a C1-C12 alkyl group containing no heteroatom.

17. The engine oil composition of claim 2, wherein each R is independently hydrogen or a C1-C12 alkyl group containing at least one heteroatom selected from Oxygen, Sulfur and Nitrogen.

18. The engine oil composition of claim 3, wherein each R is independently hydrogen or a C1-C12 alkyl group containing no heteroatom.

19. The engine oil composition of claim 3, wherein each R is independently hydrogen or a C1-C12 alkyl group containing at least one heteroatom selected from Oxygen, Sulfur and Nitrogen.

20. The engine oil composition of claim 6, wherein each R is independently hydrogen or a C1-C12 alkyl group containing no heteroatom.

21. The engine oil composition of claim 6, wherein each R is independently hydrogen or a C1-C12 alkyl group containing at least one heteroatom selected from Oxygen, Sulfur and Nitrogen.

22. An engine oil composition, comprising:

an engine oil; and an ashless oil additive comprising at least one triazabicyclo compound, wherein the triazabicyclo compound comprises at least two tertiary amines, and wherein the triazabicyclo compound is represented by the formula (III):

(III)

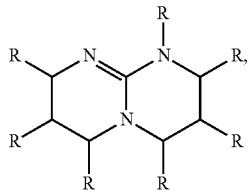

and wherein each R is independently hydrogen or a C1-C12 alkyl group optionally containing at least one heteroatom selected from Oxygen, Sulfur and Nitrogen.

* * * * *